US007116275B2

(12) United States Patent
Hedrick

(10) Patent No.: US 7,116,275 B2
(45) Date of Patent: Oct. 3, 2006

(54) OPERATIONALLY RECONFIGURABLE ARRAY

(75) Inventor: Jerry Hedrick, Manlius, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 40 days.

(21) Appl. No.: 11/046,314

(22) Filed: Jan. 28, 2005

(65) Prior Publication Data

US 2006/0170608 A1 Aug. 3, 2006

(51) Int. Cl.
*H01Q 1/38* (2006.01)

(52) U.S. Cl. ..... 343/700 MS; 343/853; 343/876

(58) Field of Classification Search ..... 343/700 MS, 343/853, 876
See application file for complete search history.

(56) References Cited

U.S. PATENT DOCUMENTS 6,885,345 B1 * 4/2005 Jackson ..... 343/700 MS
6,965,349 B1 * 11/2005 Livingston et al. ..... 343/767
2003/0089899 A1 5/2003 Lieber et al.
2004/0041617 A1 3/2004 Snider et al.
2004/0135951 A1 7/2004 Stumbo et al.

* cited by examiner

*Primary Examiner*—Hoang V. Nguyen
(74) *Attorney, Agent, or Firm*—Plevy, Howard & Darcy, PC

(57) ABSTRACT

A reconfigurable array including: a plurality of imaging layer including an array of software addressable pixels; a conductive/non-conductive layer being positioned with respect to corresponding ones of the pixels such that addressing them causes corresponding portions of the conductive/non-conductive layer to be conductive; a radiator layer being positioned with respect to corresponding ones of the pixels such that addressing them defines at least one radiator array; a switching and summing layer positioned with respect to corresponding ones of the pixels such that the addressing them causes corresponding portions of switching and summing layer to switch and sum the signals; and, a plurality of inputs coupled to the imaging layers and being under software control to selectively activate the pixels.

4 Claims, 8 Drawing Sheets

Fig. 13
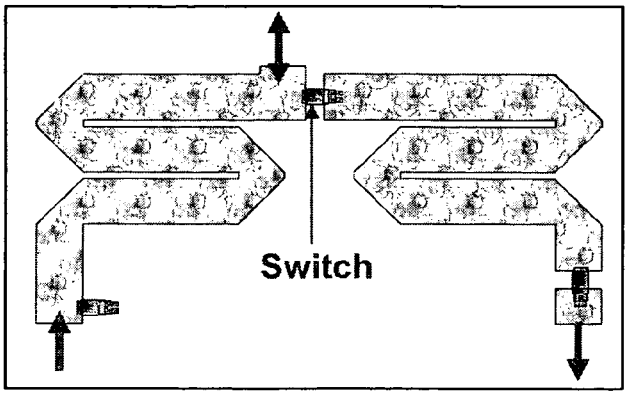
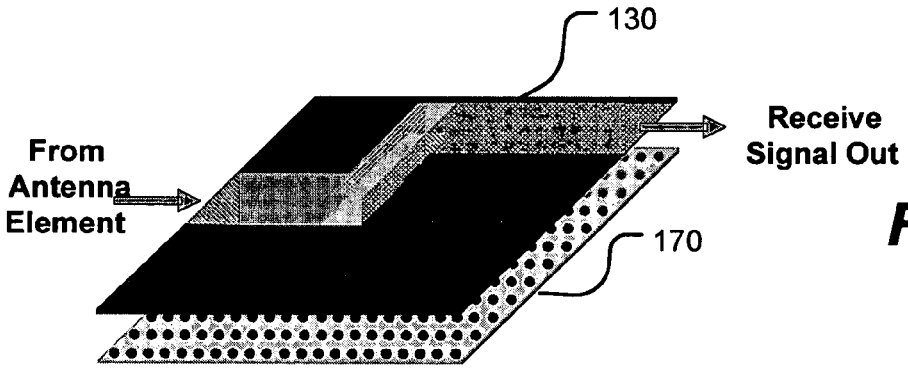
Fig. 14A
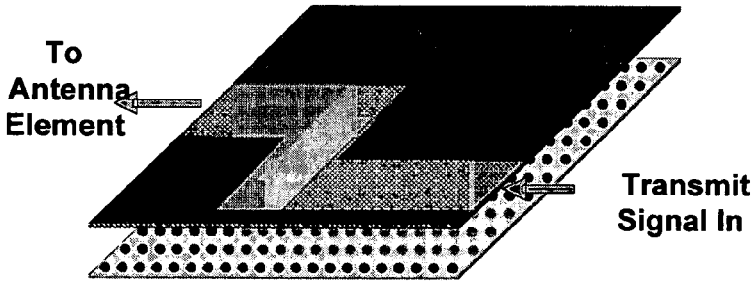
Fig. 14B

OPERATIONALLY RECONFIGURABLE ARRAY

FIELD OF THE INVENTION

The present invention relates generally to sensor systems, and more particularly, to a reconfigurable array of signal sensors.

BACKGROUND OF THE INVENTION

Many conventional techniques exist for transmitting or detecting electromagnetic radiation signals. However, changing operational requirements render many of them unsuitable for certain applications. For example, it is believed to be desirable to provide high altitude airships with sophisticated sensor arrays. These ships are desired to remain on station for substantial periods of time and at very high altitudes for upwards of one year, without refueling.

It is desirable to provide a reconfigurable radiator array suitable for extended service that is relatively lightweight and flexible, and having relatively reduced power requirements as compared to conventional arrays.

SUMMARY OF THE INVENTION

A reconfigurable array including: a plurality of imaging layers including an array of software addressable pixels; a conductive/non-conductive layer including a material that is selectively conductive and positioned with respect to corresponding ones of the pixels such that addressing of corresponding ones of the pixels causes corresponding portions of the conductive/non-conductive layer to be conductive; a radiator layer including a plurality of elements suitable for actively transmitting or receiving signals in a first mode and being passive in a second mode, the radiator layer being positioned with respect to corresponding ones of the pixels such that the addressing of the corresponding ones of the pixels causes the elements to define at least one radiator array; a switching and summing layer including a plurality of elements suitable for selectively switching and summing the signals, the switching and summing layer being positioned with respect to corresponding ones of the pixels such that the addressing of the corresponding ones of the pixels causes corresponding portions of switching and summing layer to switch and sum the signals; and, a plurality of inputs coupled to the imaging layers and being under software control to selectively activate the pixels.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts, and:

FIG. 13 illustrates a high power switch suitable for use with an array according to an aspect of the present invention;

FIGS. 14A and 14B illustrate a functional switch according to an aspect of the present invention; and, FIG. 15 illustrates an array according to an aspect of the present invention.

DETAILED DESCRIPTION OF THE PREFERRED EMBODIMENTS

It is to be understood that the figures and descriptions of the present invention have been simplified to illustrate elements that are relevant for a clear understanding, while eliminating, for the purpose of clarity, many other elements found in typical sensor systems and methods of making and using the same. Those of ordinary skill in the art may recognize that other elements and/or steps may be desirable in implementing the present invention. However, because such elements and steps are well known in the art, and because they do not facilitate a better understanding of the present invention, a discussion of such elements and steps is not provided herein.

According to an aspect of the present invention, sensors and sensor arrays may be integrated into a platform structure itself. These arrays may be conformal and flexible in nature. These arrays may be well suited for sensing relatively low, slow, small and erratic targets of interest, such as people, rocket propelled grenade launchers, ground vehicles and ultra-lights, by way of non-limiting example.

According to an aspect of the present invention, it may be desirable that such systems support real beam imaging, spherical coverage and VHF & X-Band Radars. According to an aspect of the present invention, large area, low power density arrays may be provided. Such an array may be a reconfigurable array and/or support simultaneous sensor operations (e.g. high and low frequency radar, broadband ESM, Comm, etc.), and may have a range of about 600 km, all by way of non-limiting example only.

Arrays utilized according to an aspect of the present invention may be large as compared to traditional radar arrays. For example, the area of an array according to the present invention may be on the order of thousands of square meters ($m^2$), as opposed to tens of square meters, in size. In an exemplary embodiment, the array may be on the order of about 1600 $m^2$ in area.

Figure 1:
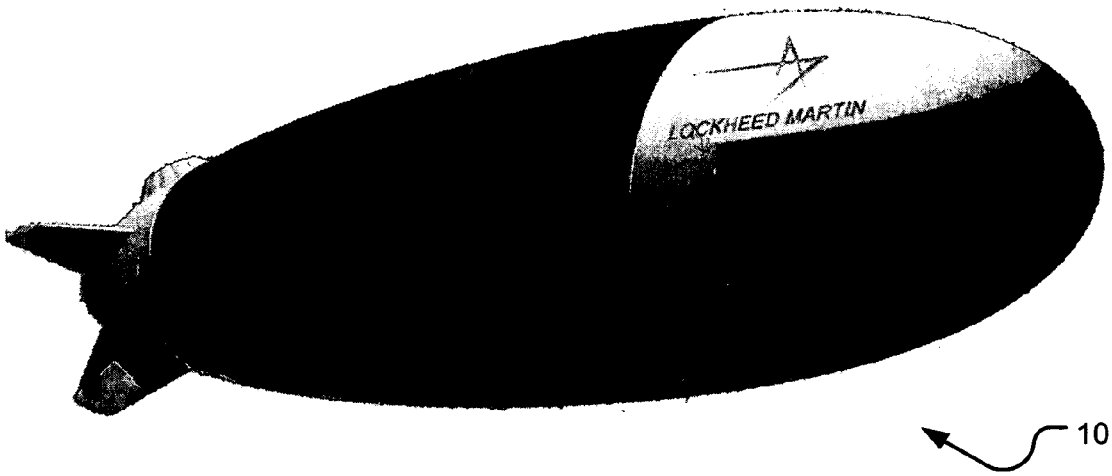
FIG. 1 illustrates a platform according to an aspect of the present invention.

Referring now to FIG. 1, there is shown a platform 10 suitable for use as a platform for an array according to the present invention. Platform 10 is shown as a high altitude air ship, by way of non-limiting example only. Platform 10 may be greater than about 150 m long and 50 m tall, also by way of non-limiting example.

Arrays according to the present invention may operate as multifunctional sensors by supporting two or more radars (e.g., AMTI/GMTI; ESM; Comms). They may be operable with a broadband electromagnetic radiation spectrum and provide interleaved/shared/reconfigurable/reprogrammable RF sensor apertures.

According to an aspect of the present invention, a hardware array that can be programmed and controlled by software during operations may be provided. Radiator type, including radiator shape, size, and placement within the array may be programmed. Electronic circuitry, such as DC supply circuitry and RF circuitry, like stripline, microstrip and MMIC components, may be programmed. According to an aspect of the present invention, a ground plane configuration may be programmed. Various layer material characteristics may be programmed to optimize/adapt array operational performance, as a function of frequency, space, time and/or power, for example.

According to an aspect of the present invention, an array may be programmed for desired frequency coverage (narrow band or broadband; VHF to Ku or higher, for example). According to another aspect of the present invention, an array may be programmed for desired functionality (radar, electronic support measures, communications and/or electronic attack, for example).

The array performance may be controlled to adapt to changing environments and threats, and to improve array performance where traditional sensor performance may tend to degrade. According to an aspect of the present invention, material layers may be varied to tune array performance for changes in frequency, beam steer angle, temperature and array surface deflections, for example.

According to an aspect of the present invention, a controllable multi-layered approach may be used that includes antenna elements, and transmit and receive amplification functionality. Other circuit components may be added as well—for example, other RF components in both transmit and receive chains may be incorporated.

According to an aspect of the present invention, the layers may be thin and flexible, so that the array can be made for 3-D conformal applications requiring the surface to be flexible during operation (e.g., airship 10 of FIG. 1).

Figure 2:
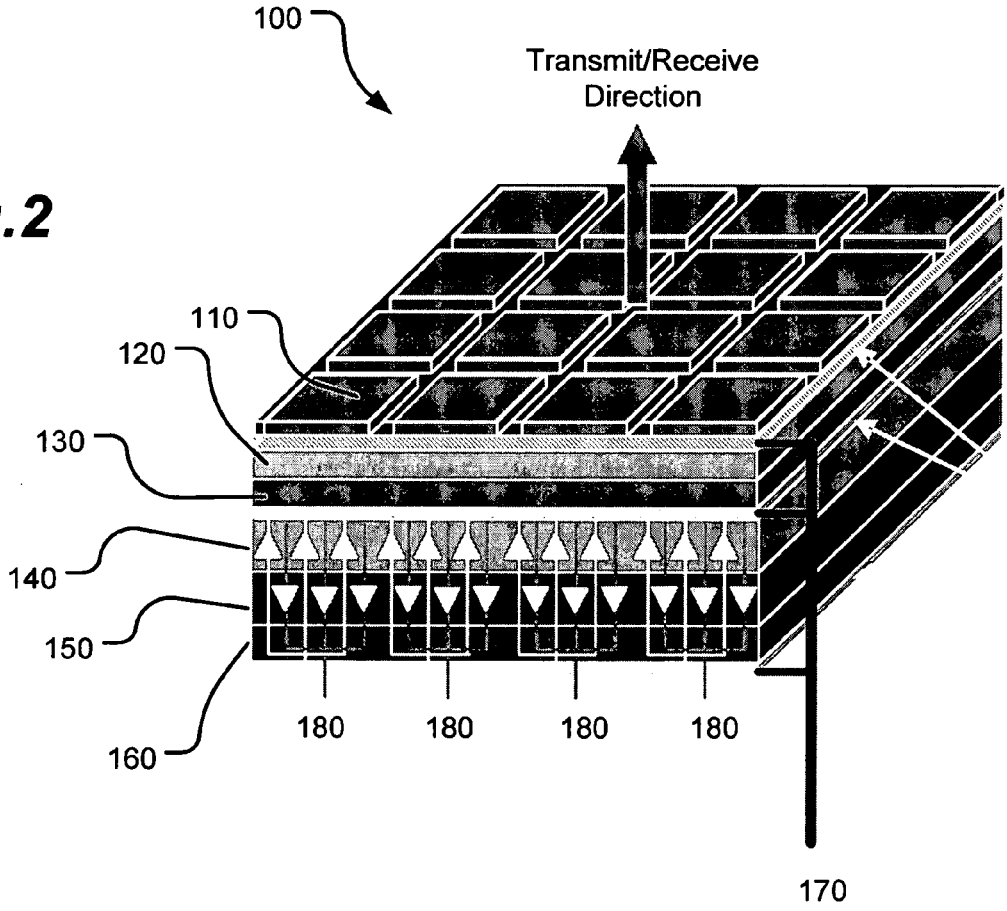
FIG. 2 illustrates an array according to an aspect of the present invention.

Referring now also to FIG. 2, there is shown a diagrammatic representation of an array 100 according to an aspect of the present invention. Generally, array 100 includes one or more radiator array layers 110, one or more variable tuning layers 120, one or more ground plane layers 130, one or more transmit power amplification layers 140, one or more receive limiter layers 150, one or more summing layers 160, one or more imaging layers 170 and radiator input/outputs (I/O's) 180. System 100 may be flexible and conformal in nature, and may be thin, such as on the order of 1 mm or less in thickness. In general, imaging layers 170 may be controllable, such that layers 110–160 may be controlled. Control may be effected by means of computer software, by way of non-limiting example only.

Figure 3:
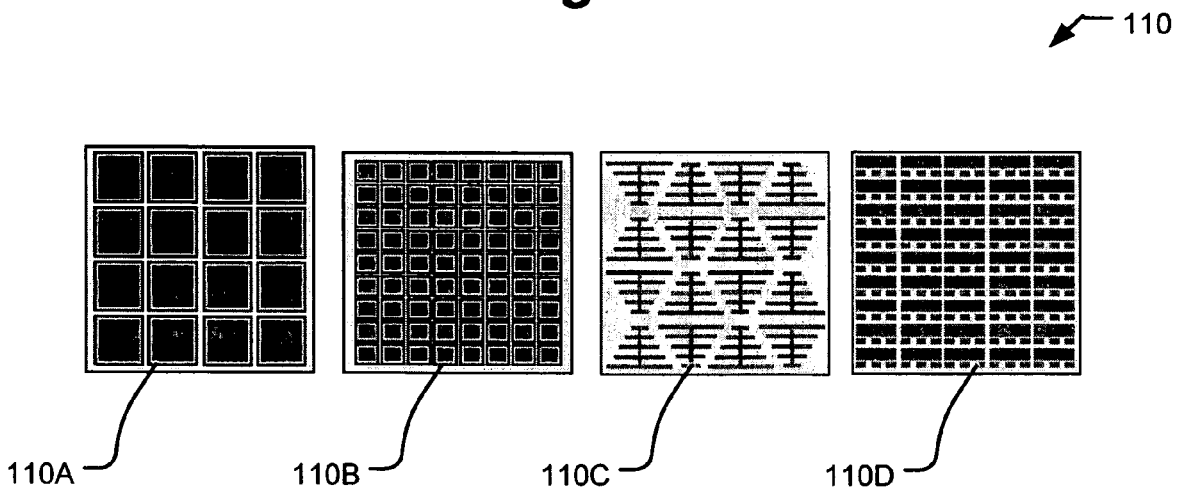
FIG. 3 illustrates various operational configurations of an array according to an aspect of the present invention.

Referring now also to FIG. 3, radiator array layer(s) 110 may take the form of selectively conducting/non-conducting (CNC) layers as will be described. Layer(s) 110 may define a plurality of arrays. For example, layers 110 may provide for a variety of programmable array features, such as radiator shape, size, and spacing. FIG. 3 illustrates a variety of radiator configurations. Configuration 110A is illustrative of a low frequency radar array. Configuration 110B is illustrative of a high frequency radar array. Configuration 110C is illustrative of a low periodic broadband ESM (Electronic Surveillance Measures) array. And, configuration 110D is illustrative of a dual band radar array having interleaved elements. As will be understood by those possessing an ordinary skill in the art, configurations 110A–110D are periodic homogeneous arrays that represent non-limiting examples of possible configurations of layer(s) 110; other configurations are possible as well.

Figure 4:
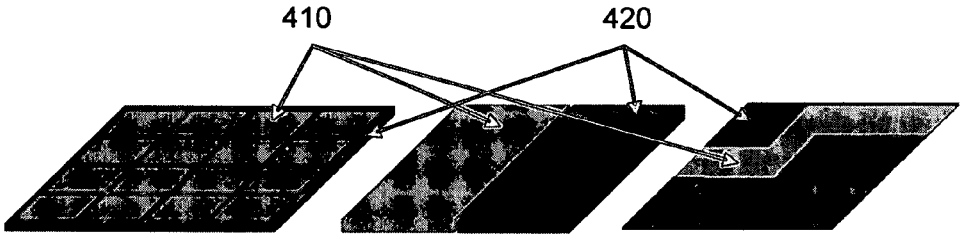
FIG. 4 illustrates a conductive/non-conductive layer according to an aspect of the present invention.
Figure 5:
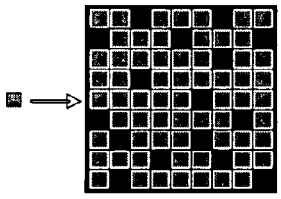
FIG. 5 illustrates a pixel configuration for an imaging layer according to an aspect of the present invention.

Referring now also to FIG. 4, according to an aspect of the present invention, where an electromagnetic field is applied to the layer 110, corresponding portions 410 of layer 110 are conductive in nature. Where no field is applied, corresponding portions 420 of layer 110 act as an insulator or dielectric. According to an aspect of the present invention, conducting and non-conducting portions 410, 420 may be selectively arranged by selectively applying an electromagnetic field to layer 110 to selectively provide different functionality. That is, an array according to the present invention may be operated in different modes, each corresponding to a different functionality (e.g., configurations 110A–110D) by selectively applying different electromagnetic fields to layer 110. Referring now also to FIG. 5, the resolution of selectability may be based upon the smallest addressable radiator or circuit dimension.

Figure 6:
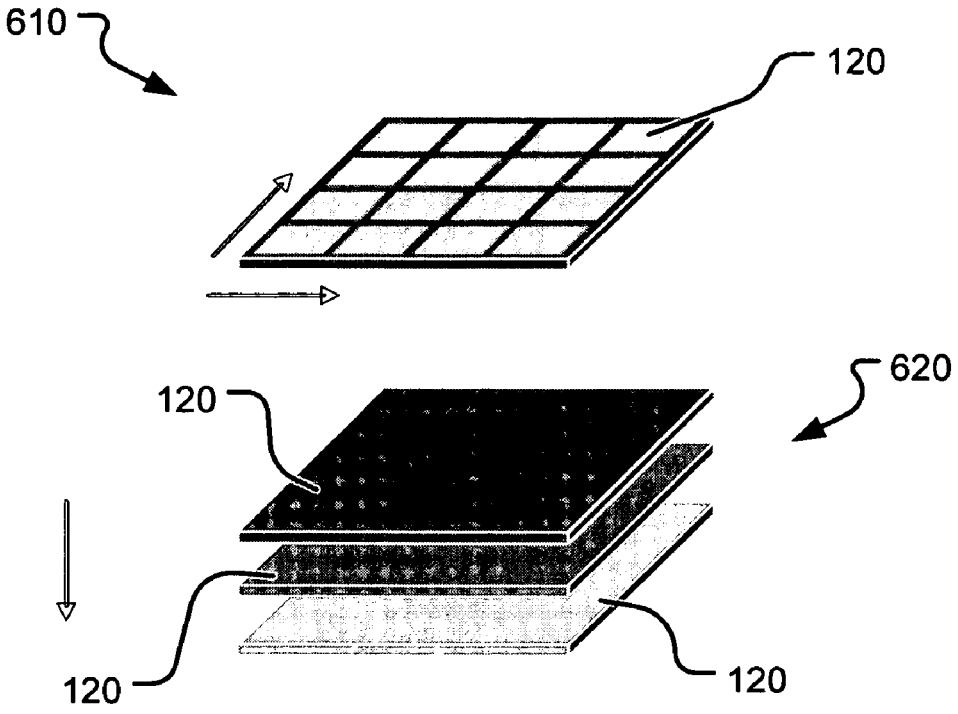
FIG. 6 illustrates variable tuning material layers according to an aspect of the present invention.

Referring now to FIGS. 2 and 6, array 100 may include one or more variable tuning layers 120. According to an aspect of the present invention, material properties may be varied across material layers (as is shown in illustration 610). According to an aspect of the present invention, material properties may be varied from layer to layer (as is shown in illustration 620). Properties that may be varied include the electrical and/or magnetic properties, such as conductivity, dielectric constant and magnetic permeability. Other properties that may be varied include physical properties, such as thickness and the introduction of deformities such as cavities. Other properties that may be varied include ferro-, magneto-, piezo- and optical properties.

As will be understood by one possessing an ordinary skill in the pertinent arts, by varying materials in these manners, an array according to an aspect of the present invention may be suitable for providing tunability from around 100 MHz to around 18 GHz, by way of non-limiting example. It may further support operations up into the W-band, for example. The variation in properties may also provide controllable isolation, impedance matching, and frequency and thermal response tuning between individual radiating elements.

Figure 7:
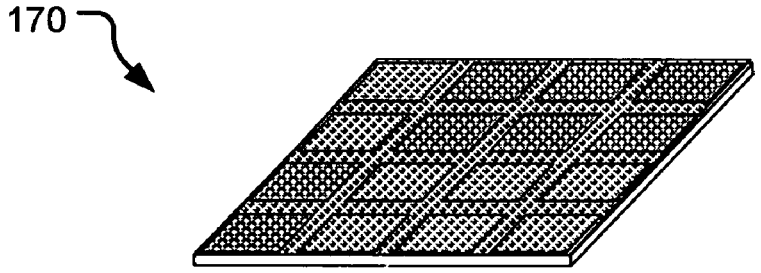
FIG. 7 illustrates an imaging layer according to an aspect of the present invention.

Referring now also to FIGS. 2 and 7, there are shown imaging layers 170. Each imaging layer 170 is controllable. For example, each imaging layer 170 may be software controlled. This controllability may be used to form desired images that may be used to control the material properties of others of the layers of array 100. Imaging layers 170 may create fields that impinge other layers, to control material properties thereof. For example, imaging layers 170 may define the antenna shape and spacing of layer 110. Imaging layers 170 may define conductive areas, and/or areas having other properties, in ground plane layers 130. Imaging layers 170 may define areas having desired material characteristics in material layers 120, such as dielectric constant, permeability, E-field and H-field. Imaging layers 170 may selectively activate and/or deactivate functional transistors in layers 140, 150. Imaging layers 170 may also control switching in summing layer 160.

According to an aspect of the present invention, each layer 170 may be composed of an array of pixels, or areas. Each pixel may serve as a control switch to selectively provide material control functionality. Such a switch may be a simple two position switch or a variable switch, for example. Each pixel may be selectively activated under software control, for example.

According to an aspect of the present invention, each pixel may include an array of nanowire transistors. In addition, nanowire edge electronics (not shown) can be used to control nanowire column, row and pixel transistors. Nanowire edge electronics can also be used to drive column, row and pixel transistors that are now made using nanowires. Nanowire edge electronics can include nanowire shift registers, nanowire level shifters and nanowire buffers, for example. Nanowire shift registers refer to a shift register implemented using nanowire transistors. Nanowire level shifters refer to level shifters implemented using nanowire transistors while nanowire buffers refer to a buffer implemented using nanowire shifters. Other types of edge electronics can be implemented using nanowire transistors. In one configuration, a voltage is applied to a nanowire column transistor for the column in which the pixel is located. The nanowire row transistor for the row in which the pixel is located will be turned on to allow current to flow to the nanowire pixel transistor. When the nanowire pixel transistor is on, current flows through the nanowire pixel transistor to make the voltage across the pixel, approximately the same as the voltage applied on the column to generate the desired signal being transmitted through the pixel. According to another aspect of the present invention, each pixel may include an array of quantum dots. According to an aspect of the present invention, each pixel may further include an array of light emitting devices or LEDs. Reference can be made to U.S. published Patent Application 20040135951 entitled "Integrated Displays Using Nanowire Transistors" published on Jul. 15, 2004 for illustration of exemplary switch circuitry and fabrication techniques useful in implementing the present invention, the teachings and subject matter thereof incorporated herein by reference in its entirety.

Regardless of the specific configuration, each pixel may be fed by an array of nanowires to selectively supply power. The array of nanowires may be used to selectively activate pixels under software control, for example. In an exemplary embodiment, a configurable nanowire transistor array may be implemented to carry out the principles of the invention as comprising one or more pairs of crossed nanowires, wherein one set of nanowires include a semiconductor material having a first conductivity and the other set of nanowires include either a metal or a second semiconductor material, and (b) a dielectric or molecular species to trap and hold hot electrons. The nano-scale wire transistors either form a configurable transistor or a switch memory bit that is capable of being set by application of a voltage that is larger in absolute magnitude than any voltage at which the transistor operates. The pair of wires may cross at a closest distance of nanometer scale dimensions and at a non-zero angle. Reference can be made to U.S. published Patent Application 20040041617 entitled "Configurable Molecular Switch Array" published on Mar. 4, 2004 for illustration of exemplary switch circuitry and fabrication techniques useful in implementing the present invention, the teachings and subject matter thereof incorporated herein by reference in its entirety.

The pixel density of a layer 170 may define the smallest radiator feature and hence the achievable image quality or resolution.

Figure 8:
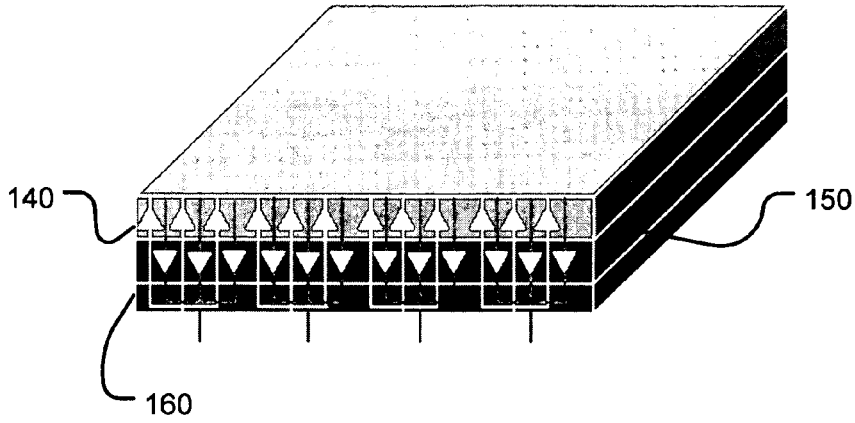
FIG. 8 illustrates transmit, receive and summing layers according to an aspect of the present invention.

Referring now also to FIGS. 2 and 8, there are shown amplification, receive and summing layers 140, 150, 160 for providing transistor functionality. That is, they may be thought of as providing a plurality of transistors. In the case of layer 140, these transistors may be used to amplify signals to handle high power levels to effectuate transmission from array 100. In the case of layer 150, they may be used to amplify signals with a low noise figure to effectuate receiving signals using array 100. Layer 150 may also provide a limiting functionality to prevent burnout during reception, as will be understood by those possessing an ordinary skill in the pertinent arts. In the case of layer 160, the transistors may be used as switches for combining or summing signals going to or coming from radiator element layer 110. They may be used to form one signal input in a transmit mode and to form one signal output in a receive mode. According to an aspect of the present invention, each of layers 140, 150 and 160 may take the form of a physically separate layer to enable enhanced frequency coverage.

Figure 9:
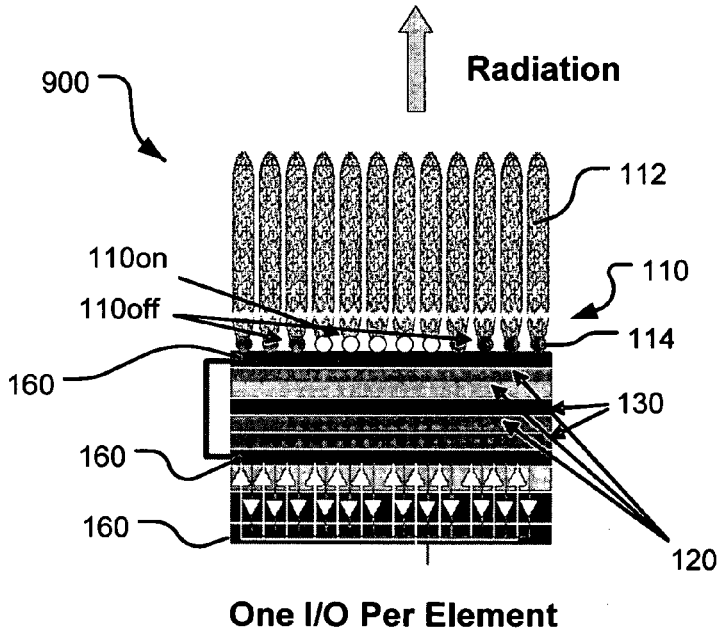
FIGS. 9 and 10 illustrate an array according to an aspect of the present invention.
Figure 10:
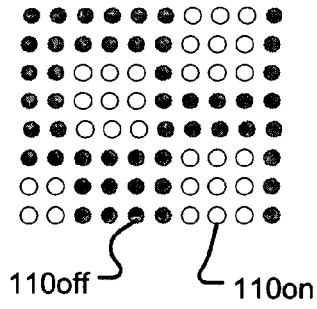

Referring now also to FIGS. 9 and 10, there is shown a diagrammatic view of a non-limiting example of an array 900 according to an aspect of the present invention. Consistently with array 100, array 900 includes summing layers 160, tuning layers 120, ground layers 130 and radiator layer 110.

Array layer 110 includes nanostructures 112. In the illustrated case of FIG. 9, nanostructures 112 take the form of carbon nanotubes. As is understood in the pertinent arts, carbon nanotubes are a variant of crystalline carbon. Carbon nanotubes are structurally related to cagelike, hollow molecules composed of hexagonal and pentagonal groups of carbon atoms, or carbon fullerene "buckyballs", or C60. Generally, there are three types of nanotubes: zigzag, armchair and chiral tubes of different diameters. Carbon nanotubes may generally be single or multi-walled. Single walled carbon nanotubes may have diameters on the order of about 1.2 to 1.4 nm. Multi-walled carbon nanotubes have diameters up to about 50 nanometers, by way of non-limiting example. Carbon nanotubes may have lengths that can be greater than 1 micron (μm), and even around 10 μm, for example.

Referring still to FIGS. 9 and 10, nanotubes 112 may be formed into an array using a patterned catalyst. For example, iron or nickel may be patterned using conventional methodologies to provide a patterned substrate for nanotube growth, such as by using plasma enhanced, high frequency chemical vapor deposition. The present invention, in many embodiments may be implemented to include nanoscopic wires, each of which can be any nanoscopic wire, including nanorods, nanowires, organic and inorganic conductive and semiconducting polymers, nanotubes, semiconductor components or pathways and the like. Other nanoscopic-scale conductive or semiconducting elements that may be used in some instances include, for example, inorganic structures such as Group IV, Group III/Group V, Group II/Group VI elements, transition group elements, or the like, as described below. For example, the nanoscale wires may be made of semiconducting materials such as silicon, indium phosphide, gallium nitride and others. The nanoscale wires may also include, for example, any organic, inorganic molecules that are polarizable or have multiple charge states. For example, nanoscopic-scale structures may include main group and metal atom-based wire-like silicon, transition metal-containing wires, gallium arsenide, gallium nitride, indium phosphide, germanium, or cadmium selenide structures. Reference can be made to U.S. published Patent Application 20030089899 entitled "Nanoscale Wires and Related Devices" published on May 15, 2003 for illustration of exemplary circuitry and fabrication techniques useful in implementing the present invention, the teachings and subject matter thereof incorporated herein by reference in its entirety.

Referring still to FIGS. 9 and 10, an array 114 may serve as an imaging layer (i.e., imaging layer 170 of FIG. 2), and take the form of a matrix of quantum dots or nanotransistors and nanowires, and may provide for selective operability of nanotubes 112. Nanotubes 112 may be semiconductive in nature. By activating select pixels of array 114, corresponding portions of nanotubes 112 may be activated, or excited into an energy emitting/receiving state, while other portions 110 off remain inactivated. By energizing select pixels of array 114 via software control, such as by using a matrix addressing scheme, specific portions (i.e., 110 on) may be selectively energized using a voltage to energize different radiator patterns.

Figure 11:
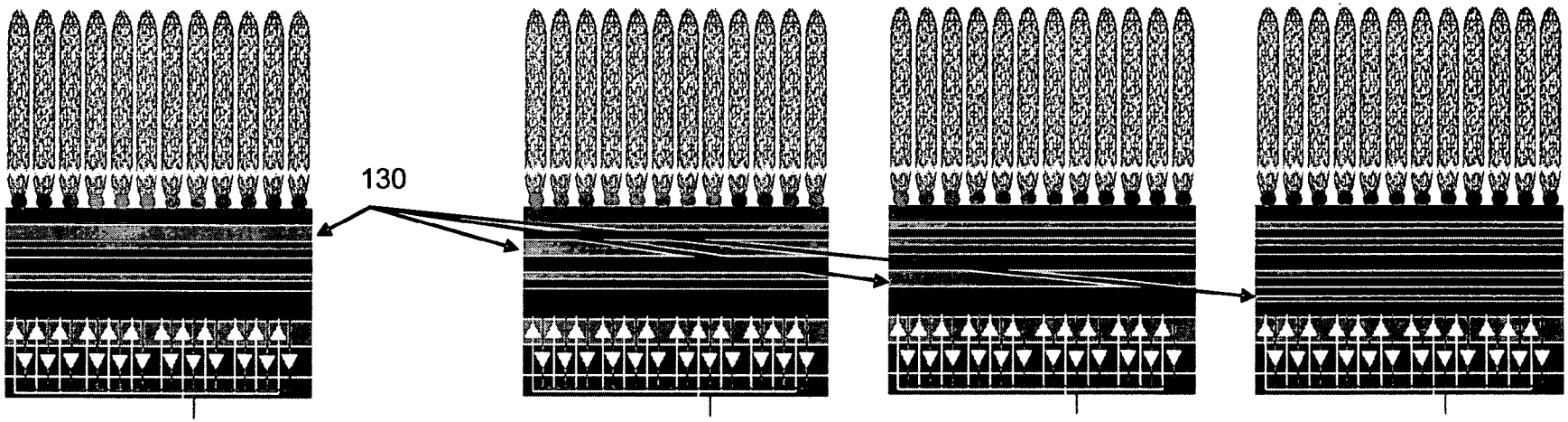
FIG. 11 illustrates different operational modes of an array according to an aspect of the present invention.

Referring now also to FIG. 11, different ground planes 130 may be selected for operation. According to an aspect of the present invention, a series of alternating imaging layers 170 and ground layers 130 may be provided. Hundreds of such layers may be provided. The imaging layer material property (e.g., dielectric constant) may be graded down the stack (e.g., a lower value at the top and increasing in value as one progresses down the stack). A ground layer may be selected, under software control, to become an active ground plane for enabling the desired electrical response from radiator array 110. By alternating ground layers 130 with variable tuning layers 120, a programmable tuner with incremental selection (e.g. bits) of both material property (e.g., dielectric constant or magnetic permeability) and thickness may be used to provide frequency and impedance tuning.

Figure 12:
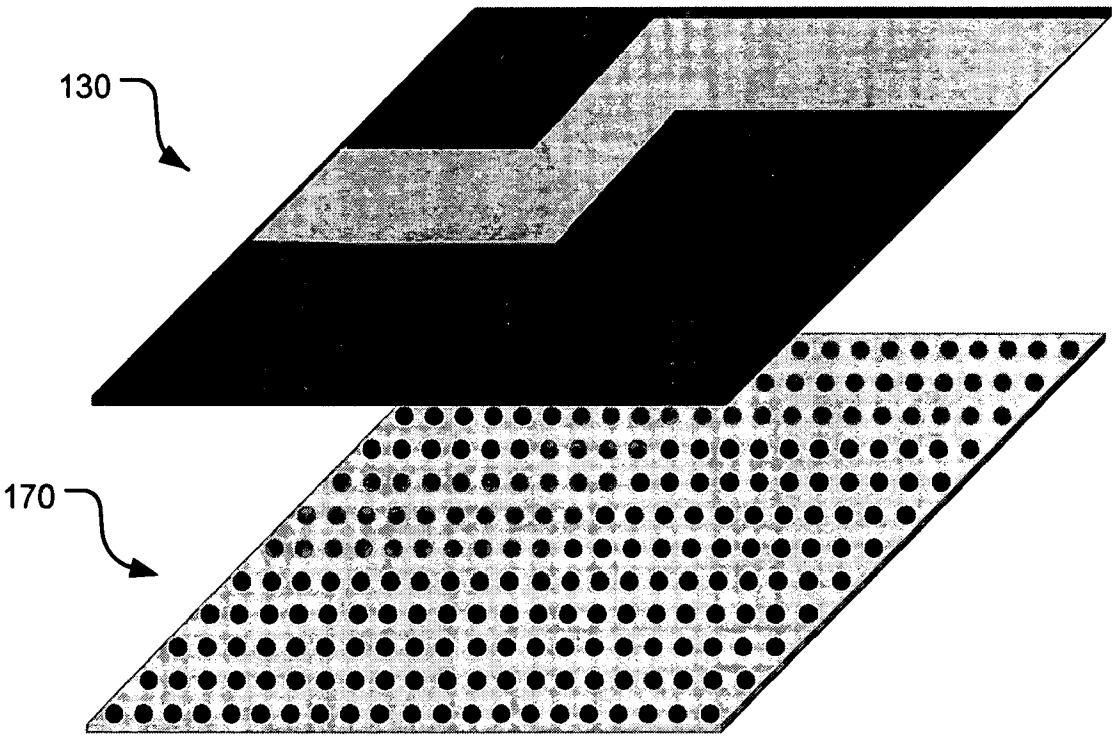
FIG. 12 illustrates an inter-relation between conductive/non-conductive layer and pixels of an imaging layer according to an aspect of the present invention.

According to an aspect of the present invention, ground layers 130 may be analogously configured of carbon nanotubes. By activating select pixels of corresponding imaging layers 170, corresponding portions of ground layers 130 may be activated or excited into a conductive state, while other portions remain inactivated and hence non-conductive in nature. Referring now also to FIG. 12, there is shown an exploded view of a ground layer 130 and corresponding imaging layer 170. In application, layers 130 and 170 may be very close to or in contact with one another.

According to another aspect of the present invention, real-time electrical circuitry configuration may be effected through software control. Analog and digital circuit components associated with signal routing, such as signal and supply lines, may be effected by selectively activating portions of ground layers. RF circuitry (e.g., stripline, microstrip, MMIC components, and signal routing) may also be effected.

As set forth, imaging layer 170 may take the form of a lattice of quantum dots or nanotransistors, and may provide control voltages to ground layer 130 to form desired circuitry. As select areas of imaging layer 170 are activated, corresponding nanotubes of ground layer 130 become excited and transition from a non-conducting to a conducting state. That is, ground layer 130 becomes conducting where imaging layer 170 provides a control voltage and non-conducting where no control voltage is supplied.

Referring now also to FIG. 13, there is shown an exemplary configuration of a high isolation/high power switch controlling selection of transmit or receive functionality in an array according to the present invention. Referring now also to FIGS. 14A and 14B, there is shown an embodiment to the switch of FIG. 13 using the re-programmability of conductive paths in individual layers 130 over time to eliminate the need for a physical switch. As will be understood by one possessing an ordinary skill in the pertinent arts, this may serve to eliminate loss and isolation problems associated with the switch.

Figure 15:
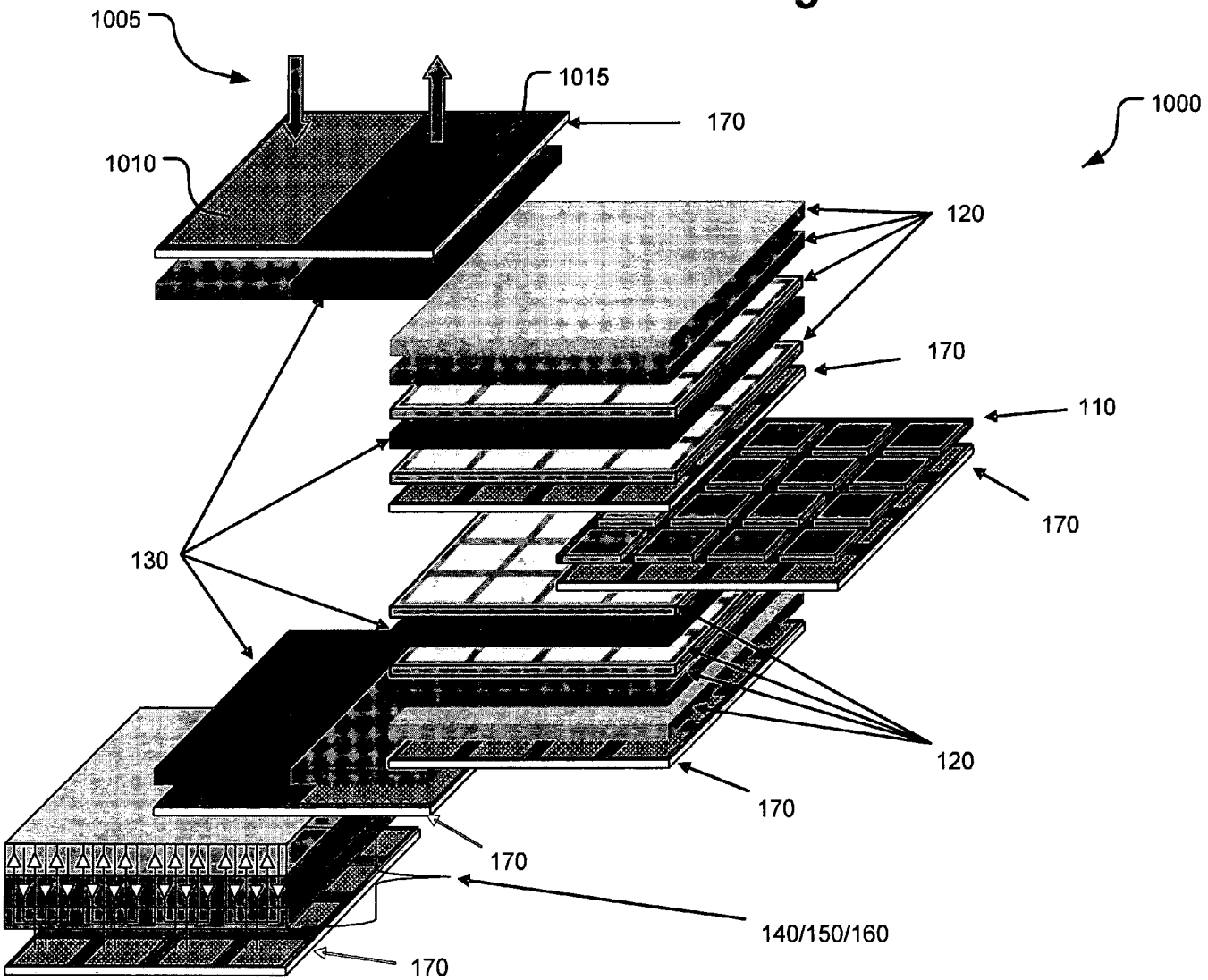

Referring now to FIG. 15, there is shown an exploded representation of an array 1000 according to an aspect of the present invention. Array 1000 is well suited for transmitting and receiving electromagnetic signals in the general directions 1005. Array 1000 may provide for single or dual functionality. As shown in FIG. 15, a first portion 1010 may perform as a receiver, while a second portion 1015 performs as a transmitter.

Array 1000 may include one or more radiator layers 110, a plurality of variable tuning layers 120, a plurality of ground layers 130, transmit, receive and summing layers 140, 150, 160, and a plurality of imaging layers 170. By selectively controlling the imaging layers 170 and material properties of variable tuning layers 120, conducting and non-conducting regions of ground planes 130 may be selectively operated. Also by selectively controlling the imaging layers 170, the shape and dimensions of radiator elements in array 110 may be defined. Also by selectively controlling imaging layers 170, the operation of layers 140, 150, 160 may be controlled, such as to provide for the dual-functionality illustrated, for example.

Those of ordinary skill in the art may recognize that many modifications and variations of the present invention may be implemented without departing from the spirit or scope of the invention. It is intended that the present invention covers the modifications and variations of this invention provided they come within the scope of the appended claims and their equivalents.

What is claimed is:

1. A reconfigurable array comprising:

a plurality of imaging layers each comprising an array of software addressable pixels;

a conductive/non-conductive layer comprising a material that is selectively conductive and positioned with respect to corresponding ones of said pixels such that said addressing said corresponding ones of said pixels causes corresponding portions of said conductive/non-conductive layer to be conductive;

a radiator layer comprising a plurality of elements suitable for actively transmitting or receiving signals in a first mode and being passive in a second mode, said radiator layer being positioned with respect to corresponding ones of said pixels such that addressing said corresponding ones of said pixels causes said elements to define at least one radiator array comprising elements in said first mode separated by elements in said second mode;

a switching and summing layer comprising a plurality of elements suitable for selectively switching and summing said signals, said switching and summing layer being positioned with respect to corresponding ones of said pixels such that addressing said corresponding ones of said pixels causes corresponding portions of switching and summing layer to switch and sum said signals; and, a plurality of inputs coupled to said imaging layers and being under software control to selectively activate said pixels.

2. The array of claim 1, further comprising a plurality of layers having varying material characteristics.

3. The array of claim 2, wherein said material characteristics of one of said plurality of layers of varying material characteristic varies according to position thereof.

4. The array of claim 2, wherein the material characteristics of different ones of said plurality of layers having varying material characteristics are different.

* * * * *